US005911315A

United States Patent [19]

Flowers

[11] Patent Number: 5,911,315

[45] Date of Patent: Jun. 15, 1999

[54] BICYCLE HELMET AND STRAP ADAPTER

[76] Inventor: John D. Flowers, 4970 Pleasant Oaks Dr., Wilmington, N.C. 28412

[21] Appl. No.: 08/840,413

[22] Filed: Apr. 29, 1997

Related U.S. Application Data

[ 60] Provisional application No. 60/016,348, Apr. 30, 1996.

[51] Int. Cl.[6] ..... A42B 3/08

[52] U.S. Cl. ..... 2/421; 2/425

[58] Field of Search ..... 2/421, 422, 424, 2/425, 410, 411

[56] References Cited

U.S. PATENT DOCUMENTS

| | | | |
|---|---|---|---|
| 2,769,176 | 11/1956 | Grancsay et al. | 2/421 |
| 3,311,921 | 4/1967 | Helm | 2/421 |
| 3,447,163 | 6/1969 | Bothwell et al. | 2/421 |
| 3,619,813 | 11/1971 | Marchello | 2/421 |
| 4,051,556 | 10/1977 | Davenport et al. | 2/421 |
| 4,335,472 | 6/1982 | Rappleyea | 2/421 |
| 4,398,306 | 8/1983 | Gooding | 2/421 |
| 4,646,368 | 3/1987 | Infusino et al. | 2/421 |
| 4,741,054 | 5/1988 | Mattes | 2/421 |
| 4,856,119 | 8/1989 | Haberle | 2/421 |
| 5,231,703 | 8/1993 | Garneau | 2/425 |
| 5,272,773 | 12/1993 | Kamata | 2/425 |
| 5,361,416 | 11/1994 | Petrie et al. | 2/421 |

*Primary Examiner*—Michael A. Neas
*Attorney, Agent, or Firm*—Rhodes, Coats & Bennett, L.L.P.

[57] ABSTRACT

A bicycle helmet strap having a first strap on one side of the helmet with a helmet female latch section, and a second side strap on the opposite side of the helmet with a helmet male latch section, is modified so that the helmet is be secured on the user's chin instead of being secured beneath the user's neck, by attaching an adapter between the end of the helmet straps. The adapter is formed of a chin piece to fit on the user's chin, a chin piece male latch section positioned on the chin piece for insertion into the helmet female latch section, and a chin piece female latch section positioned on the other side of the chin piece to receive the helmet male latch section. The chin piece can be a continuous flexible loop, with the chin piece latch sections being slidably positioned on the loop.

9 Claims, 2 Drawing Sheets

BICYCLE HELMET AND STRAP ADAPTER

This application claims benefit of Provisional No. 60/016,348 filed Apr. 30, 1996.

BACKGROUND OF THE INVENTION

1. Field of the Invention

The present invention relates generally to an improved protective helmet, and in particular to a bicycle rider's helmet having an improved strap for comfortably and securely holding the helmet on the rider's head. The invention also specifically relates to an improved strap adapter that can be attached to existing helmet straps to provide the advantages of the present invention.

2. Description of the Prior Art

Helmets worn by bicycle riders, and especially riders who engage in off-road bicycling activities, are comprised of a hard outer shell with a resilient inner lining to fit over the top of the rider's head, protecting the rider against head injuries. The helmet is normally secured in place by a strap attached beneath the wearer's head between the neck and chin, i.e., under the chin. These straps are usually constructed of two sections, one of which is attached to either side of the helmet. Each section is attached at its upper end to the helmet, while the lower end terminates in one part, either the male or female part, of a latch.

While these straps generally serve to adequately secure the helmet onto the wearer's head, they can cause considerable discomfort to the wearer by pressing against the wearer's throat, especially when the wearer is engaged in strenuous off-road riding or racing. As a result, wearers often tend to loosen the strap, resulting in the helmet being less than securely fastened, or forego the use of a helmet altogether. Also, the placement of the strap allows the helmet the pivot back and forth.

Thus, there is a need for a helmet that includes a strap constructed in a manner that will hold the helmet securely onto the wearer's head, while still being comfortable to the wearer. Also, since many wearers have already invested in helmets with conventional straps, there is a need for a helmet strap adapter that can be used to modify existing bicycle helmet straps to provide these attributes.

SUMMARY OF THE INVENTION

The present invention is directed to a helmet, especially a helmet designed for bicycle riders, that provides protection to the rider's head, while being comfortable to wear. Specifically, the helmet of the invention comprises an outer protective shell shaped to fit over the top of the wearer's head, a resilient liner within the shell interior and positioned to engage the wearer's head, and a unique strap to hold the shell and liner in position.

The shell and liner may be of known construction. For example, the helmet may be of a convex shape with a front, back and spaced sides. Generally, the helmet shell will be formed of an impact resistant, injection molded plastic, or fiberglass. The helmet surface may be continuous, or it may include spaced opening in its surface to allow for ventilation. The liner may be of neoprene or other resilient material to cushion the wearer's head from blows against the shell.

The unique feature of the invention resides in the strap used to hold the helmet in place. This strap may comprise three segments, two of which that may exist on conventional helmets. These segments are a first side strap, a second side strap, and a strap adapter joining the side straps. Each side strap includes an upper end attached to the helmet shell, and a lower end terminating in either the male part or female part of a latch. Each side strap my be in the shape of a "Y" with the distal ends of the upper arms of the "Y" both being attached to the helmet shell, and the latch part being attached to the lower arm of the "Y". The length of the upper arms of the "Y" may be such that the wearer's ear fits into the apex or joinder of the arms. The lengths of the side straps can normally be shortened or lengthened by an adjustment buckle.

Alternatively, the upper ends of the side straps may extend over the wear's head and join to each other, so that the entire strap is slidable relative to the helmet position. The lower ends of the side straps are constructed in the same manner as in the above construction, however.

In accordance with the present invention, a third strap member or strap adjuster is provided to join the lower ends of the side straps, and to secure the strap firmly against the wearer's chin, as opposed to positioning the strap under the wearer's jaw, between the chin and the neck. Basically this strap adapter is comprised of a central member adapted to fit onto the wearer's chin, and male and female latch members positioned on opposite sides of the central member.

The central member may be one continuous piece, as is often found on helmets of the type worn by football players, but preferably the central member is comprised of a pair of adjacent straps, one of which fits on top of the wearer's chin and the other of which fits beneath the wearer's chin.

In one embodiment of the invention, the ends of both chin straps are secured to the latch members. In this case, the upper chin strap is normally shorter than the lower chin strap, since the distance around the lower part of the chin is greater than the distance across the top of the chin. In another embodiment, the ends of one chin strap are joined to the ends of the other chin strap to form a loop. The latch members can then be slidably positioned onto the loop, so the lengths of the chin straps can adjust to equalize the pressure on the straps when the helmet is secured in place, thereby adjusting the strap lengths to the particular requirements of the wearer.

The invention contemplates the construction of an entire helmet and described above, or the modification of existing helmets using a strap adapter of the present design. In the latter case, the latch elements of the strap adapter will be of the came type as used on the existing helmet, so that the male latch member on the strap adapter will engage the female latch member on one side strap of the existing helmet, and the female latch member on the other side of the strap adapter will engage the male latch member on the other side strap of the existing helmet.

The side straps of the helmet, and the straps of the strap adjuster will normally be made of the same material. For example, woven nylon strapping can be used. Also, all of the straps, or only the straps of the strap adjuster can be made of a stretchable material, so that they yield slightly under a pulling force. Various strap materials of the kind used on existing bicycle helmets can be used in the present construction.

Thus, it is an aspect of the invention to provide a helmet strap adapter comprising a chin piece adapted to fit on a user's chin, a female latch section positioned on one side of said chin piece, and a male latch section on the opposite side of said chin piece.

It is another aspect of the invention to provide a bicycle helmet strap adapter for use with a bicycle helmet having a first side strap with a helmet female latch section, and a second side strap with a helmet male latch section adapted for insertion into said female latch section, said adapter comprising a chin piece adapted to fit on a user's chin, an adapter male latch section positioned on one side of said chin piece and adapted for insertion into said helmet female latch section, and an adapter female latch section positioned on the other side of said chin piece and adapted to receive said helmet male latch section.

It is still another aspect of the invention to provide a bicycle helmet to be worn on the head of a user including a strap to be worn of the user's chin comprising a first strap on one side of the helmet with a helmet female latch section, a second side strap on the opposite side of the helmet with a helmet male latch section, a chin piece to fit on the user's chin, a chin piece male latch section positioned on one side of said chin piece for insertion into said helmet female latch section, and a chin piece female latch section positioned on the other side of said chin piece to receive said helmet male latch section.

These and other aspects of the invention will become apparent to one skilled in the art upon reading the following Detailed Description of the Invention, taken with the drawings.

DETAILED DESCRIPTION OF THE INVENTION

Figure 1:
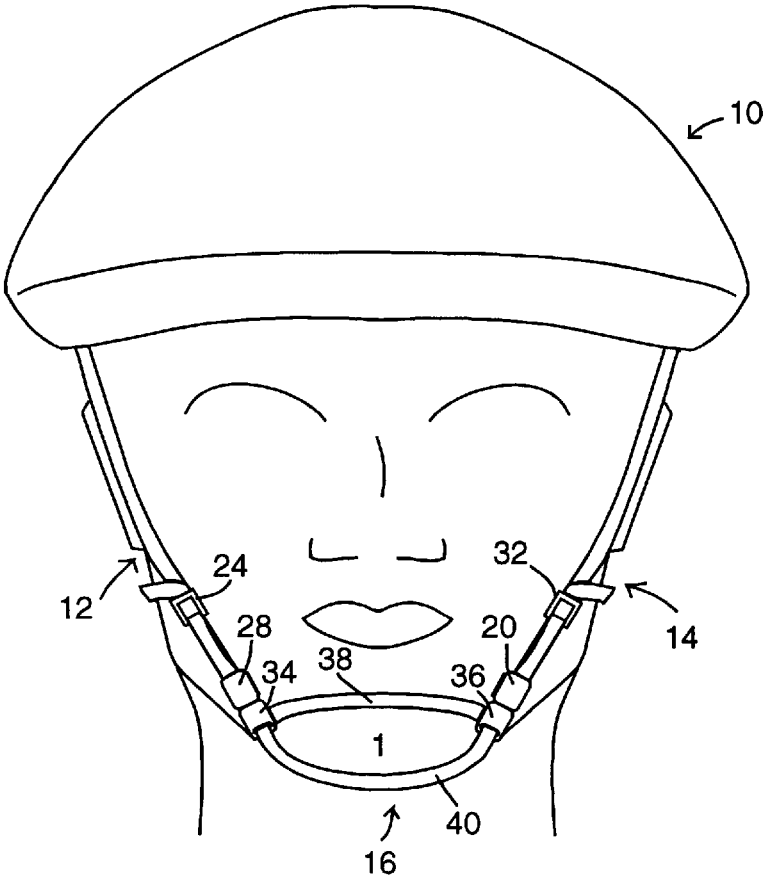
FIG. 1 is a front view of the helmet and strap.

In the following description, terms such as horizontal, upright, vertical, above, below, beneath, and the like, are used solely for the purpose of clarity in illustrating the invention, and should not be taken as words of limitation.

The preferred embodiment of the invention comprises a helmet, generally 10, formed of a hard outer shell and a resilient liner, a right strap, generally 12, a left strap, generally 14, and a chin strap adjuster, generally 16.

Right strap 12 includes a first strap section 18 extending from an upper end attached to the rear of the helmet 10, to a lower end attached to a female latch member 20. A second strap section 22 extends from an upper end attached to helmet 10 along the right side, to a lower end attached to strap section 18 between the upper and lower ends of section 18. First strap section 18 includes a length adjustment buckle 24.

Left strap 14 includes a first strap section 26 extending from an upper end attached to the rear of the helmet 10, to a lower end attached to a male latch member 28. A second strap section 30 extends from an upper end attached to helmet 10 along the left side, to a lower end attached to strap section 26 between the upper and lower ends of section 26. In a preferred embodiment, the upper ends of strap sections 18 and 26 connect at a common point at the rear of helmet 10. First strap section 26 includes a length adjustment buckle 32.

Chin strap adjuster 16 is comprised of a female latch member 34, a male latch member 36, an upper strap section 38, and a lower strap section 40. Female latch member 34 is of the same construction as female latch member 20, and male latch member 32 is of the same construction as male latch member 28. Upper and lower straps 38 and 40 may be joined at their ends to latch members 34 and 36, with lower strap section 40 being longer than section 38.

Figure 2:
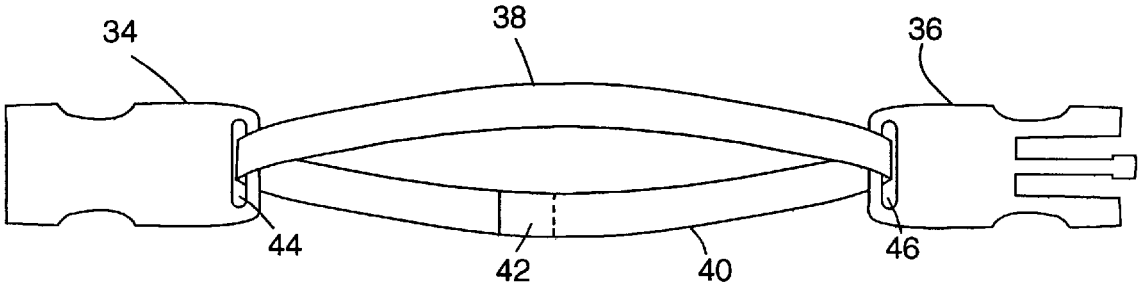
FIG. 2 is a detailed view of the chin strap adapter.
Figure 3:
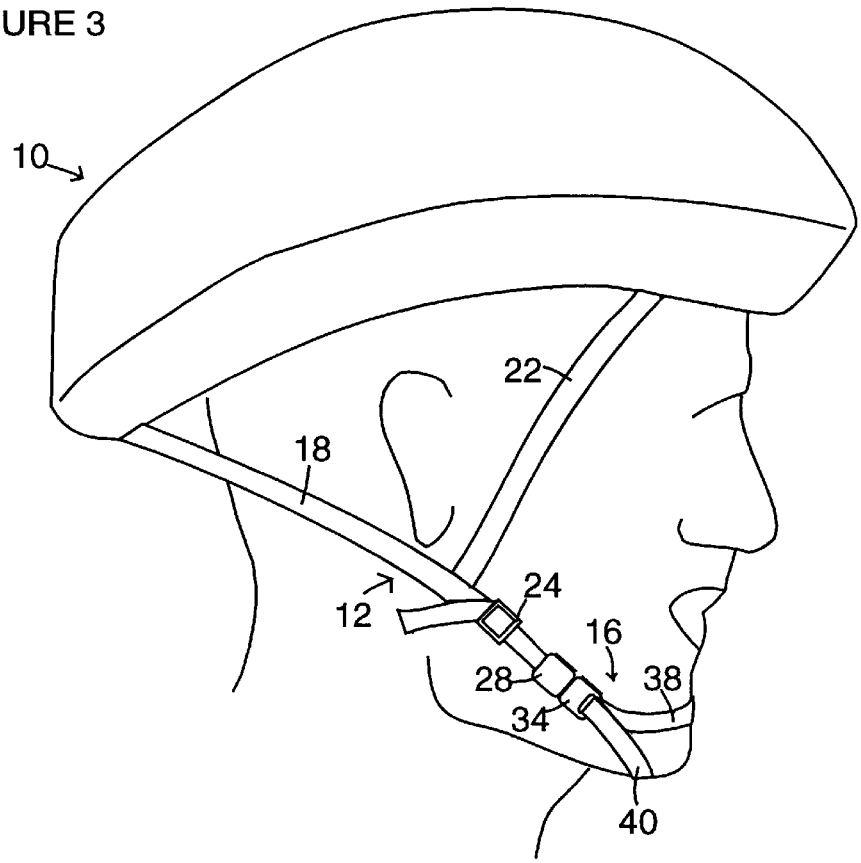
FIG. 3 is a right side view of the helmet and strap.
Figure 4:
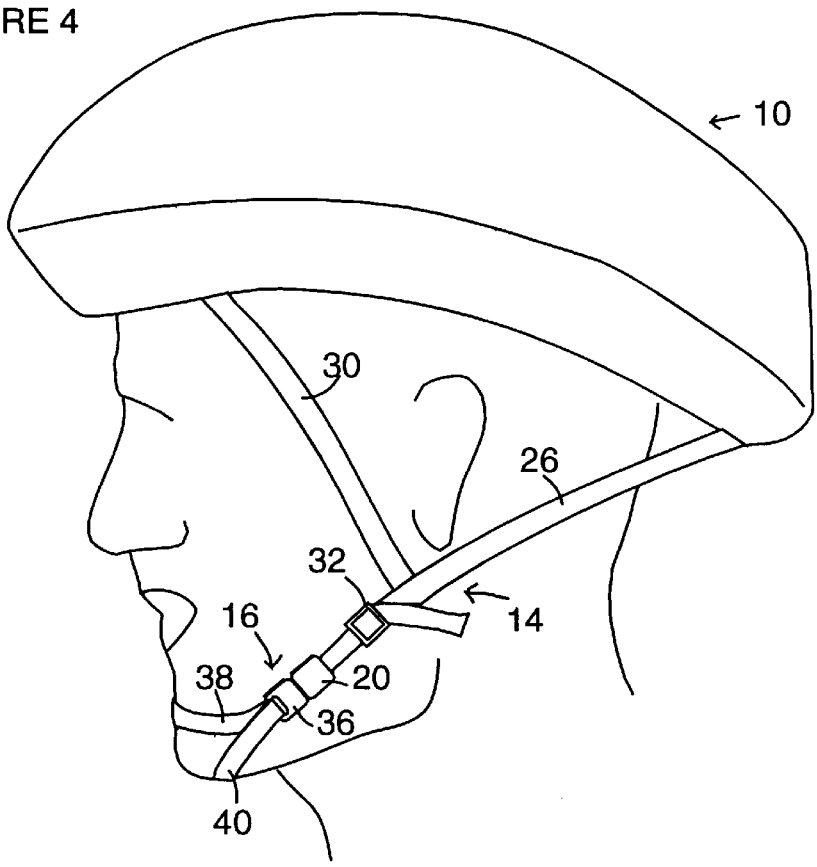
FIG. 4 is a left side view of the helmet and strap.

Alternatively, as shown in FIG. 2, sections 38 and 40 may be formed from a single band of material having its ends joined at an overlap section 42, e.g., by sewing or heat sealing. In this latter embodiment, the band slides through slots 44 and 46 in latch members 34 and 36, respectively.

When used, male latch member 36 is inserted into female member 20, and the wearer then places helmet 10 on his head. Latch member 28 is then inserted into latch member 34 of chin strap adjuster 16, with strap sections 38 and 40 being positioned above and below the user's chin. Adjustment buckles 24 and 32 may be tightened to secure the helmet and strap adjuster firmly onto the wearer's head and chin.

Certain modifications and improvements will occur to those skilled in the art upon a reading of the foregoing description. For example, the positions of the male and female latch sections can be reversed. Also, different helmet configurations can be used. It should be understood that all such modifications are properly within the scope of the invention.

What is claimed is:

1. A bicycle helmet strap adapter for attachment to a bicycle helmet, said bicycle helmet having a first side strap with a lower end, a helmet female latch section attached to the lower end of said first side strap, a second side strap with a lower end, and a helmet male latch section attached to the lower end of said second strap, said helmet male latch section being insertable into said helmet female latch section, said adapter comprising:

a) a chin piece adapted to fit on a user's chin;

b) an adapter male latch section positioned on one side of said chin piece, said adapter male latch section being configured to be insertable into said helmet female latch section; and c) an adapter female latch section positioned on the other side of said chin piece and configured to insertably receive said helmet male latch section, whereby said adapter can be attached to said helmet by inserting said adapter male latch section into said helmet female latch section and inserting said helmet male latch section into said adapter female latch section, said adapter male latch section and said adapter female latch sections being configured such that said adapter male latch section can be inserted into said adapter female latch section.

2. The adapter of claim 1, wherein said chin piece includes an upper section adapted to extend above a user's chin, and a lower section adapted to extend beneath a user's chin.

3. The adapter of claim 1, wherein said chin piece is a continuous loop.

4. The adapter of claim 1, wherein said chin piece is a continuous flexible loop, and said latch sections are slidable positioned on said loop.

5. A bicycle helmet comprising:

a ) a first side strap having a lower end;

c) a helmet female latch section attached to the lower end of said first strap;

d) a second side strap having a lower end:

e) a helmet male latch section attached to the lower end of said second strap, said helmet male latch section being configured to be insertable into said helmet female latch section;

f) a chin piece adapted to fit on a user's chin;

g) an adapter male latch section positioned on one side of said chin piece, said adapter male latch section being configured to be insertable into said helmet female latch section; and h) an adapter female latch section positioned on the other side of said chin piece, said helmet mate latch section being configured to be insertable into said adapter female latch section, said adapter male latch section and said adapter female latch sections being configured such that said adapter male latch section can be inserted into said adapter female latch section.

6. The helmet of claim 5, wherein said first and second helmet side straps, are adjustable.

7. The helmet of claim 5, wherein said first and second helmet side straps are Y-shaped.

8. The helmet of claim 5, wherein said helmet includes a resilient inner liner.

9. The helmet of claim 5, wherein said first and second helmet side straps have joined upper ends.

* * * * *